US011454913B2

(12) United States Patent
Fujimoto et al.

(10) Patent No.: US 11,454,913 B2
(45) Date of Patent: Sep. 27, 2022

(54) IMAGE FORMING APPARATUS AND IMAGE FORMING SYSTEM

(71) Applicant: CANON KABUSHIKI KAISHA, Tokyo (JP)

(72) Inventors: Tetsuichiro Fujimoto, Shizuoka (JP); Shun-ichi Ebihara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/367,772

(22) Filed: Jul. 6, 2021

(65) Prior Publication Data

US 2022/0011704 A1 Jan. 13, 2022

(30) Foreign Application Priority Data

Jul. 9, 2020 (JP) ..... JP2020-118453

(51) Int. Cl.
*G03G 15/00* (2006.01)
*G03G 15/20* (2006.01)

(52) U.S. Cl.
CPC ..... *G03G 15/5029* (2013.01); *G03G 15/2028* (2013.01)

(58) Field of Classification Search
CPC ..... G03G 15/6588; B65H 43/02; B65H 43/06
See application file for complete search history.

(56) References Cited

U.S. PATENT DOCUMENTS

| | | | | |
|---|---|---|---|---|
| 7,010,256 | B2 | 3/2006 | Usui et al. | |
| 9,989,899 | B2 | 6/2018 | Ebihara et al. | |
| 10,274,875 | B2 | 4/2019 | Sako et al. | |
| 10,409,204 | B2 | 9/2019 | Ebihara et al. | |
| 10,795,303 | B2 | 10/2020 | Ebihara | |
| 2004/0153759 | A1* | 8/2004 | Motegi | H04L 1/22 714/14 |
| 2017/0123352 | A1 | 5/2017 | Ebihara et al. | |
| 2017/0123353 | A1 | 5/2017 | Sako et al. | |
| 2018/0246444 | A1 | 8/2018 | Ebihara et al. | |
| 2018/0246455 | A1* | 8/2018 | Ebihara | G06F 3/1294 |
| 2020/0019105 | A1 | 1/2020 | Ebihara | |

FOREIGN PATENT DOCUMENTS

| | | | |
|---|---|---|---|
| JP | 2010-250227 | A | 11/2010 |
| JP | 2017-083702 | A | 5/2017 |
| JP | 2017-083704 | A | 5/2017 |
| JP | 2020-008767 | A | 1/2020 |

* cited by examiner

*Primary Examiner* — Victor Verbitsky

(74) *Attorney, Agent, or Firm* — Venable LLP

(57) ABSTRACT

An image forming system includes a first image forming apparatus and a second image forming apparatus connected with the first image forming apparatus by a network line. When a second stacking portion of the second image forming apparatus is associated with a first stacking portion of the first image forming apparatus by a setting portion, an arithmetic portion acquires information related to the characteristic of a second recording medium stacked by the second stacking portion via the network line and obtains a degree of deterioration of a feeding rotatable member of the first image forming apparatus based on the acquired information related to the characteristic of the second recording medium.

16 Claims, 8 Drawing Sheets

(a)

(b)

(a)

(b)

(b)

PAPER PARAMETER SETTING MENU

INPUT FOR TRAY SETTING

| TRAY SETTING | PRINTER NAME |
|---|---|
| FEEDING TRAY 15A' | IMAGE FORMING APPARATUS 100A |
| – | – |
| – | – |

OK CANCEL

IMAGE FORMING APPARATUS AND IMAGE FORMING SYSTEM

FIELD OF THE INVENTION AND RELATED ART

The present invention relates to image forming apparatus and image forming system, and in particular to image forming apparatus for copiers, printers, FAX machines, etc. using the electrophotographic method.

Conventional electrophotographic image forming apparatuses are generally used in copiers, printers, and fax machines. These image forming apparatuses use information on the type of recording medium (hereinafter referred to as "paper type") set by the user, or have a thickness sensor set in the image forming apparatus to understand the characteristics of the recording medium, and to optimize the image forming conditions according to the characteristics of the recording medium. This makes it possible to form images of the desired quality on a variety of recording media. In addition, the image forming apparatus of the electrophotographic method has a short lifespan compared to the lifespan of the main assembly of the image forming apparatus, such as the toner supply container and other consumables attached to the image forming apparatus, the photosensitive drum, the developer, the fusing unit, and the transfer unit. Each of these apparatuses is made into a unit, and when it reaches the end of its lifetime, the unit is replaced with a new one. Henceforth, replaceable units are referred to as replaceable units. This way, the image forming apparatus can be used continuously.

It is desirable to accurately detect or predict the lifetime of replaceable units, and to inform the user so that the replaceable unit can be used as long as possible, thereby reducing the replacement frequency and management cost. In order to accurately notify the lifetime of replaceable units, it is necessary to accurately estimate the degree of deterioration of each replaceable unit (hereinafter referred to as the degree of deterioration). Of these replaceable units, the method to accurately estimate the degree of deterioration of the rotating feeding portions involved in the feeding of the recording medium is to monitor the number of sheets of recording medium subjected to passing (hereinafter referred to as the number of sheets subjected to passing) and the number of rotations of the rotating feeding portions. In this method, when the number of sheets subjected to passing or the number of rotations exceeds the predetermined number, a message to users such as the end of lifetime beforehand or the end of lifetime is shown to the main assembly of the image forming apparatus or the personal computer (hereinafter referred to as "PC") side connected to the image forming apparatus. If the recording medium used by the user and its characteristics are known, the image forming apparatus can perform the specified calculation according to the recording medium and accurately estimate the degree of deterioration of the replaceable unit. For example, Japanese Laid-Open Patent Application No. 2017-083704 proposes a method of performing the following lifetime calculation. For example, the image forming apparatus has a detecting portion that detects the thickness of the recording medium as a characteristic of the recording medium, a type of recording medium that is determined from the thickness of the recording medium, and a memory portion that stores the type of recording medium judged from the characteristic values other than the thickness corresponding to the type (stiffness of the recording medium, amount of filler contained in the recording medium, etc.). In this image forming apparatus, the type of recording medium is determined based on the detection results of the detecting portion, and the lifetime of the rotating feeding portion is calculated using the characteristic values other than the thickness stored in the memory portion. This makes it possible to accurately estimate the lifetime of the recording medium according to the characteristic values of the recording medium actually used.

On the other hand, in recent years, managed print services (hereinafter referred to as MPS) that centrally manage and optimally allocate image forming apparatus such as multifunction printers (hereinafter referred to as MFPs), which are document output environments in offices, have begun to be provided. In the MPS environment, it is easier to grasp the characteristics of the recording medium used than in the general printing environment because the "management user" who provides the service may manage the recording medium as well. In addition, the recording medium used for each sheet feeding tray of each image forming apparatus can be managed by the management user, and the corresponding settings can be made at once via network lines, etc. This can improve the accuracy of estimating the degree of deterioration of replaceable units.

In such MPS environment, there is a need for further improvement of serviceability and the accuracy of estimating the degree of deterioration of replaceable units is required to be further improved. However, not all of the multiple image forming apparatuses managed by administrative users have detecting portions that detect the characteristics of the recording medium. Therefore, even if the management user manages the recording medium as well, there is a problem that it is not possible to accurately estimate the lifetime of the image forming apparatus that cannot detect the characteristics of the recording medium.

SUMMARY OF THE INVENTION

The present invention was made under such circumstances, with the aim of accurately predicting the lifetime of a replaceable unit even in an image forming apparatus that does not have a means of detecting the characteristics of the recording medium.

According to an aspect of the present invention, there is provided an image forming system comprising: a first image forming apparatus including a first stacking portion configured to stack a first recording medium, a feeding rotatable member configured to feed the first feeding medium, an arithmetic portion configured to obtain a degree of deterioration of said feeding rotatable member, and a setting portion configured to set so as to associate the other stacking portion with said first stacking portion; a second image forming apparatus different from said first image forming apparatus, said second image forming apparatus including a second stacking portion configured to stack a second recording medium, and a detecting portion configured to detect a characteristics of the second recording medium; and a network line configured to connect said first image forming apparatus and said second image forming apparatus, wherein when said second stacking portion is associated with said first stacking portion by said setting portion, said arithmetic portion acquires information related to the characteristic of the second recording medium detected by said detecting portion via said network line and obtains the degree of deterioration of said feeding rotatable member based on the acquired information related to the characteristic of the second recording medium.

Further features of the present invention will become apparent from the following description of exemplary embodiments (with reference to the attached drawings).

Figure 3:
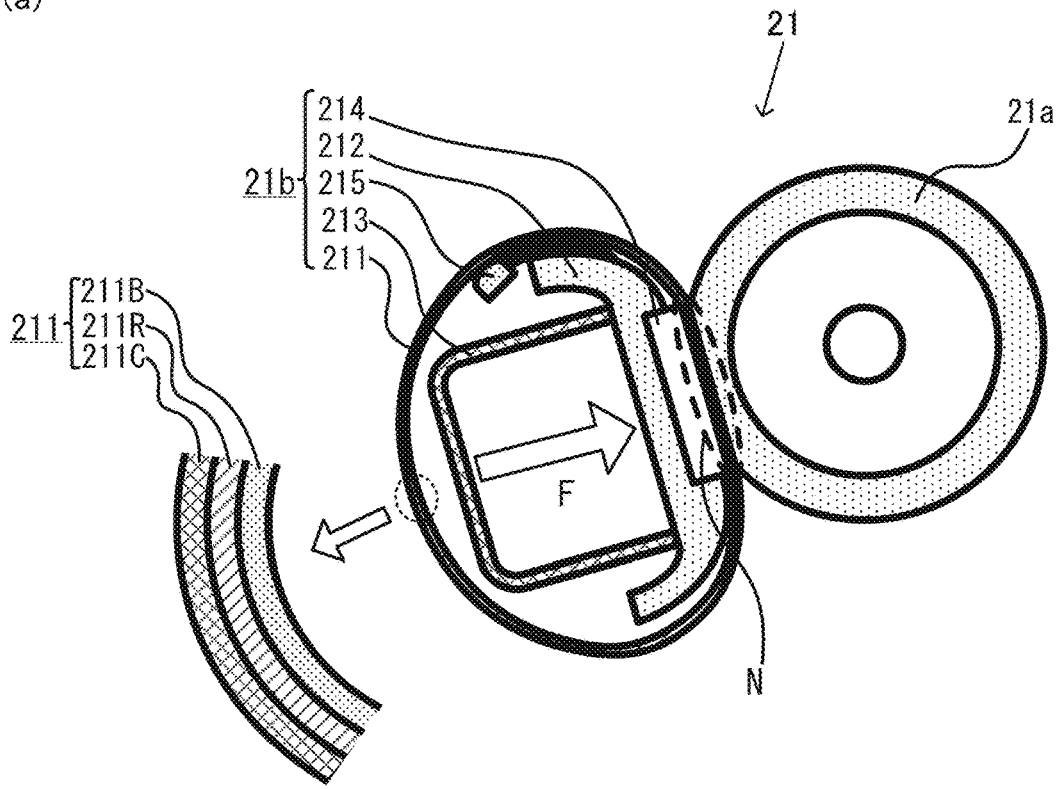
Figure 3:
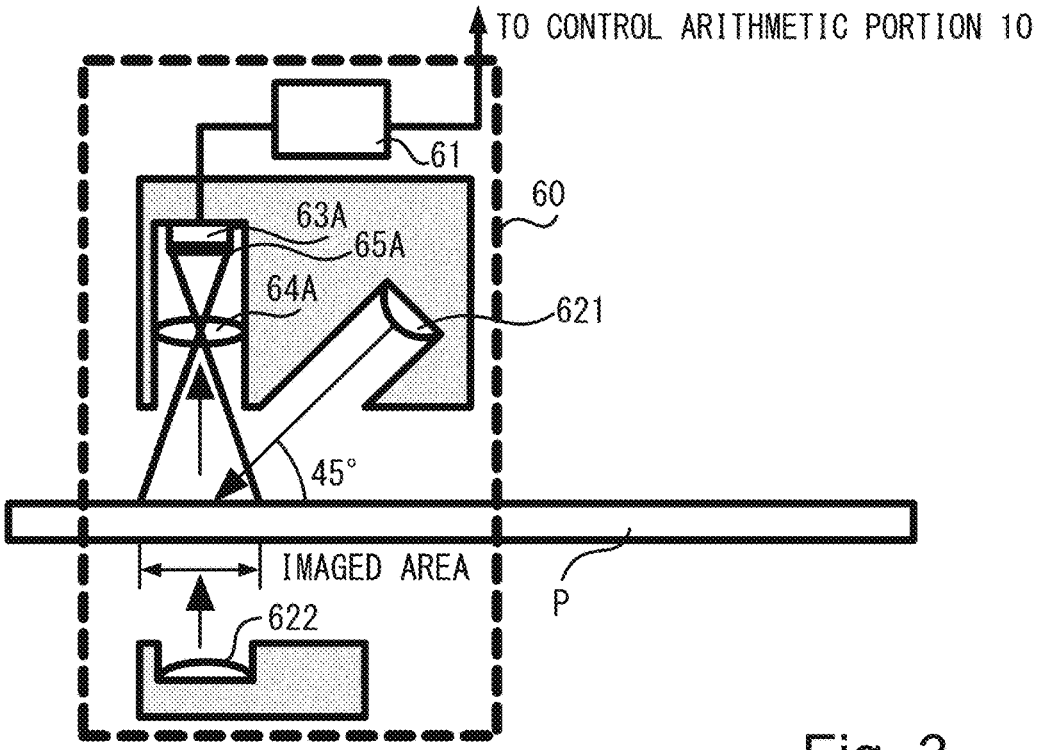

Part (a) of FIG. 3 is a schematic cross-sectional view showing the fixing portion and Part (b) of FIG. 3 is a surface smoothness/thickness sensor in the embodiment 1.

Figure 4:
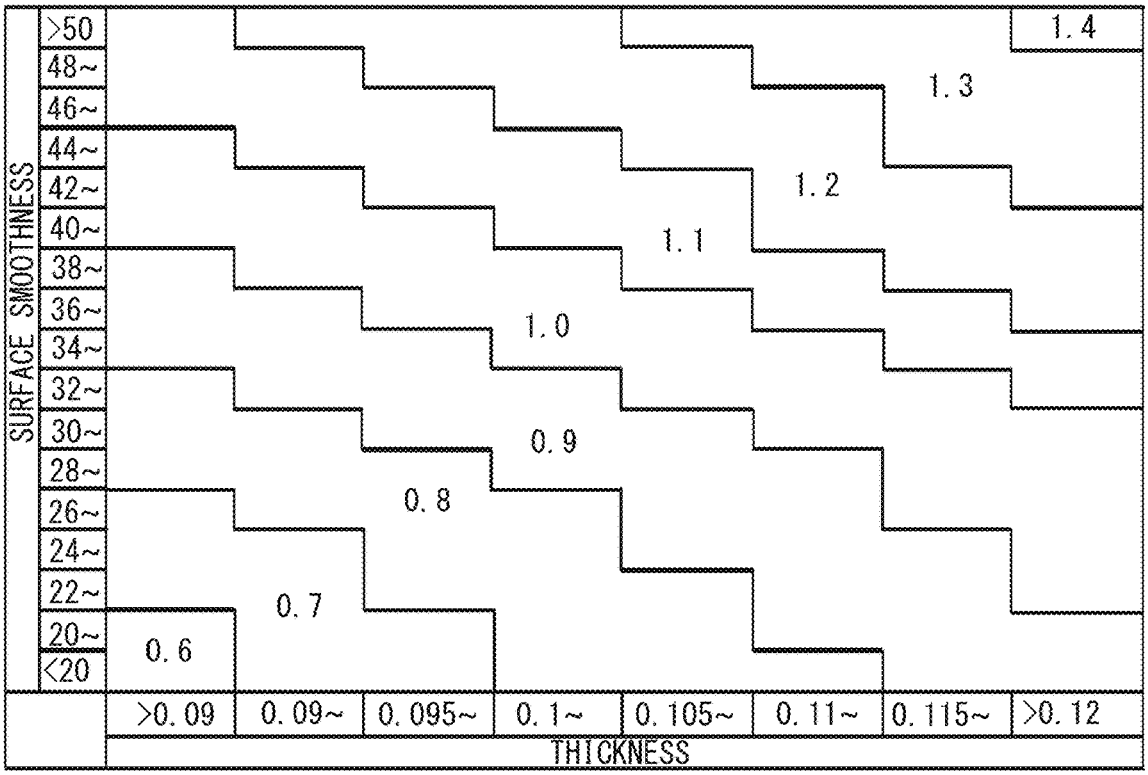
Figure 4:
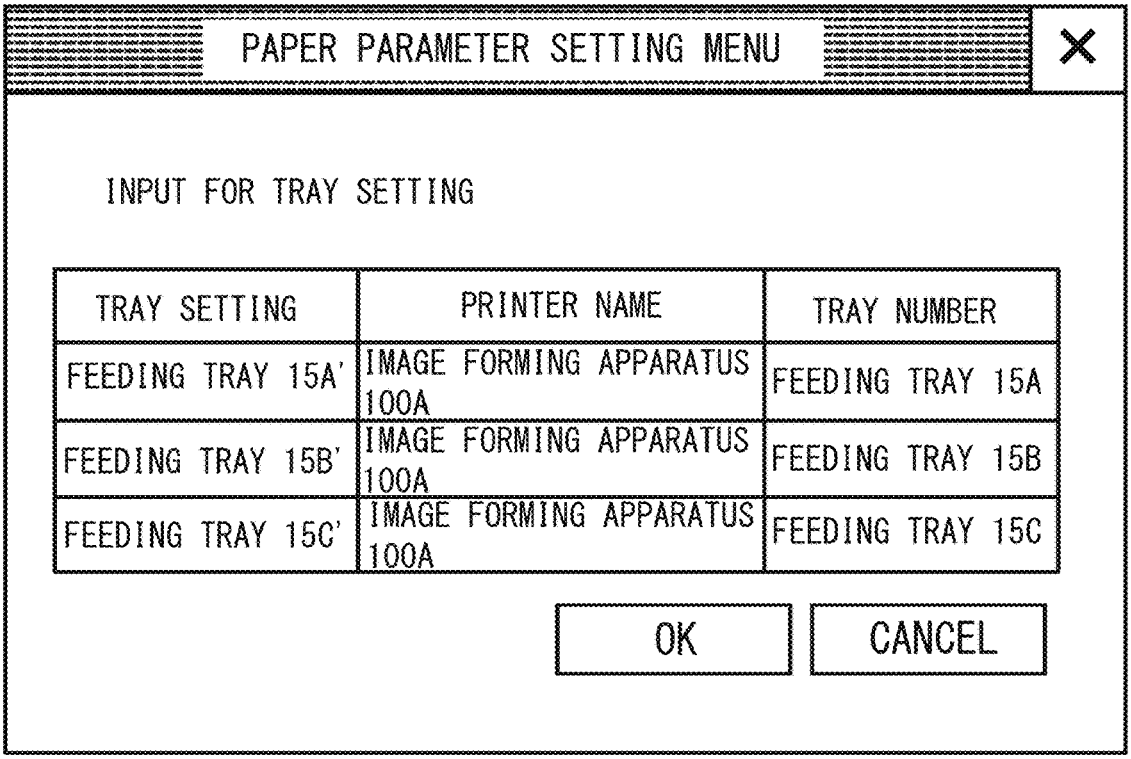

Part (a) of FIG. 4 is a drawing showing the correction factor matrix of the embodiment 1 and Part (b) of FIG. 4 is the setting screen.

Figure 5:
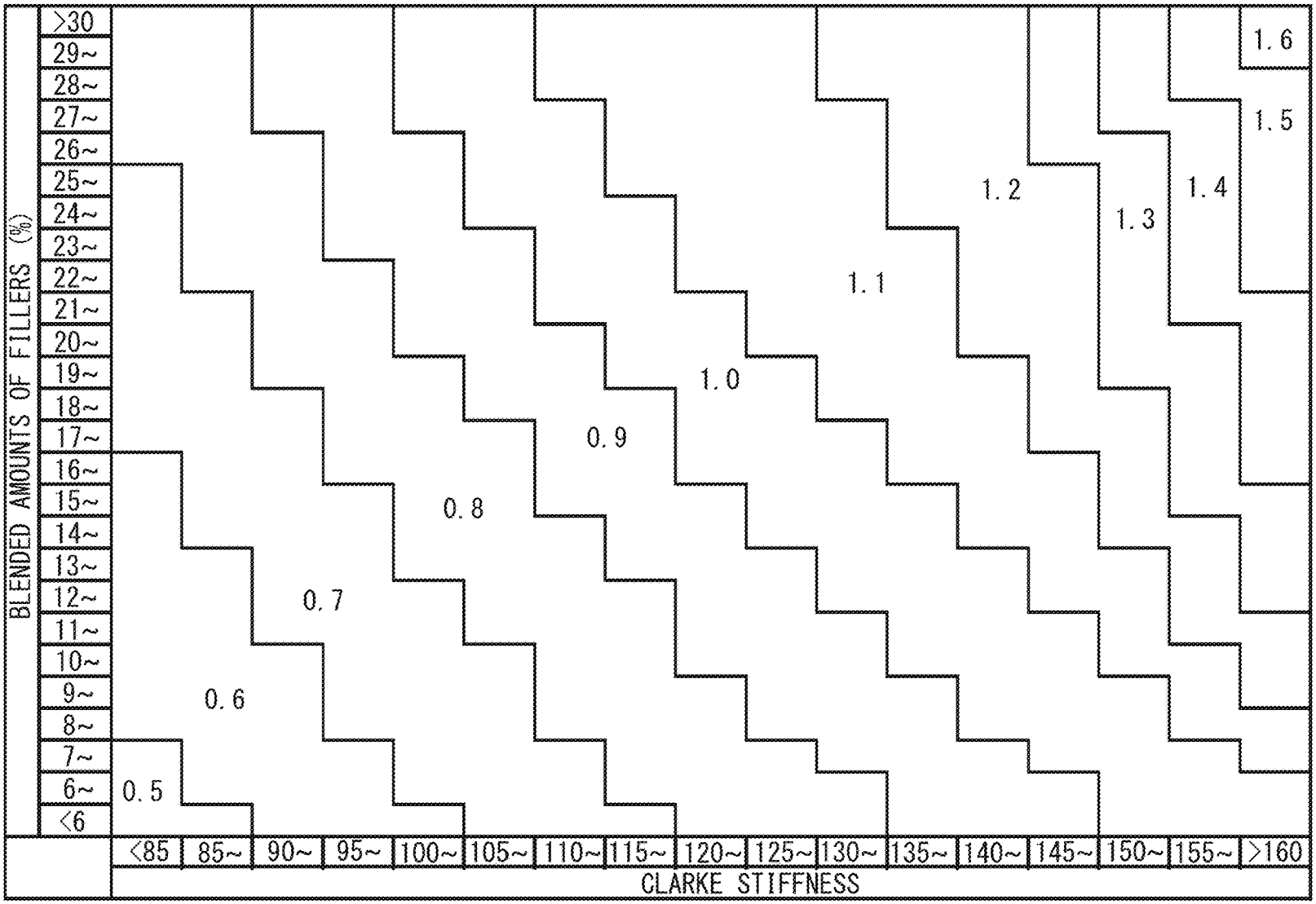

FIG. 5 is a drawing showing the correction factor matrix of the embodiment 2.

Figure 6:
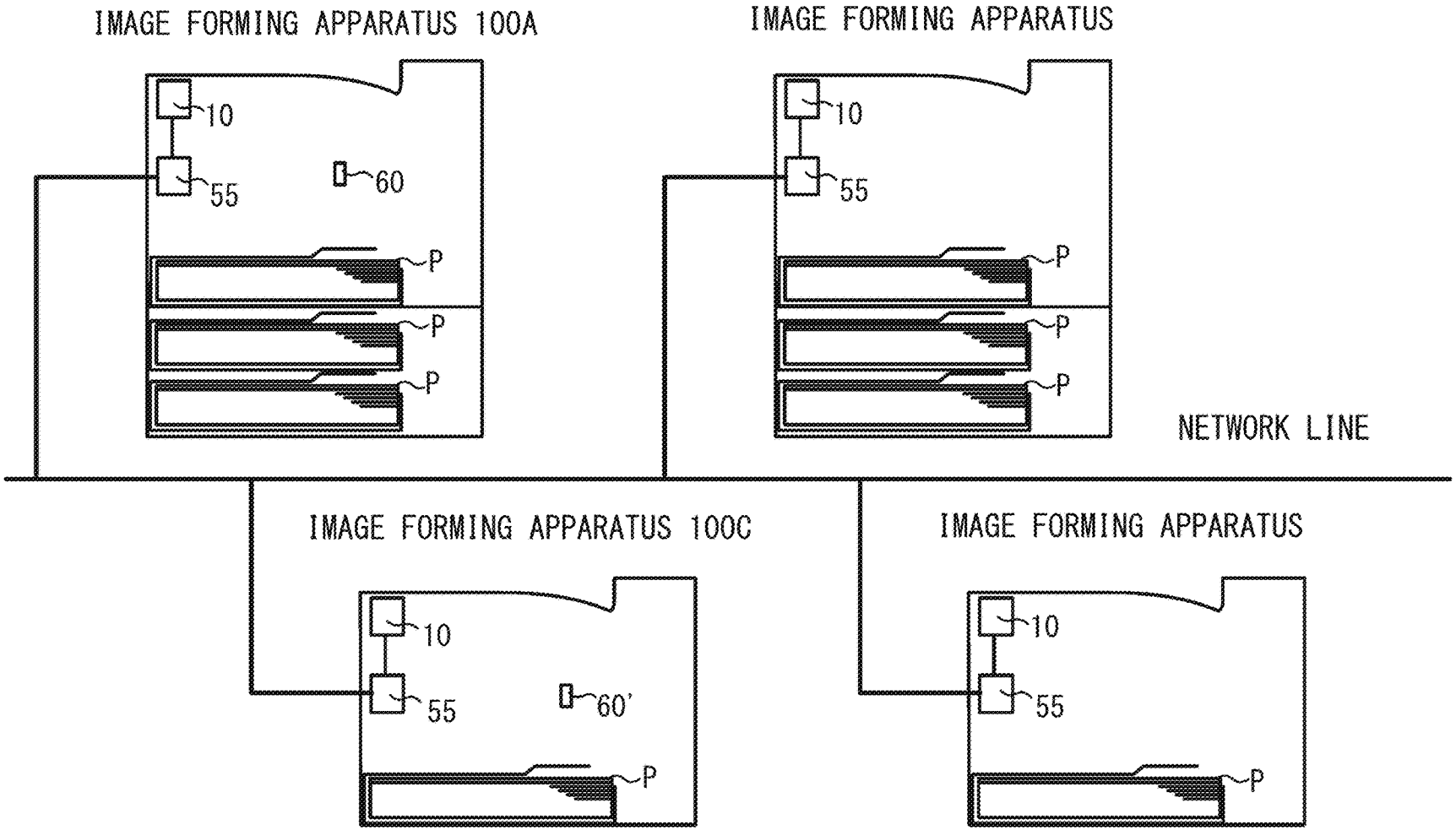

FIG. 6 is a drawing showing multiple image forming apparatuses connected to the network line in the embodiment 3.

Figure 7:
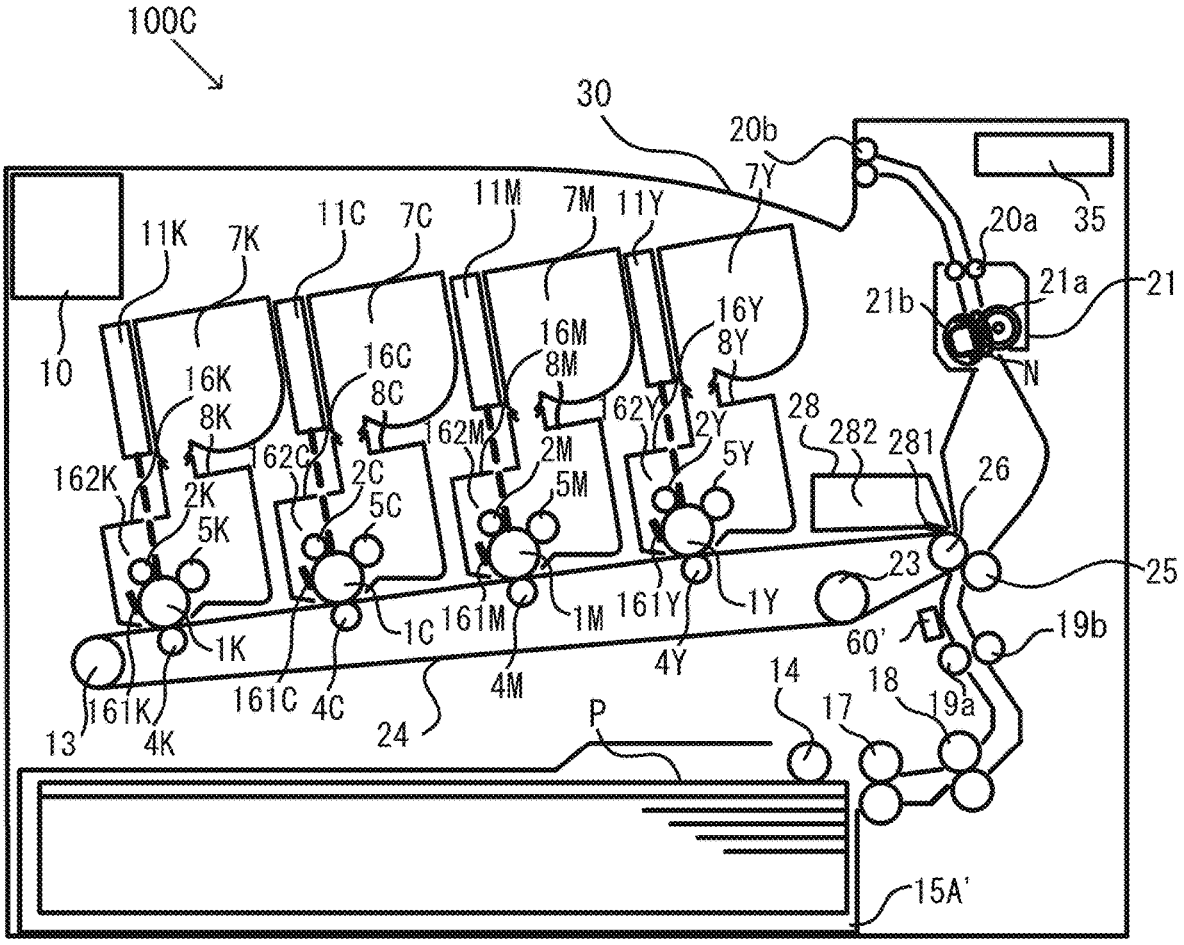

FIG. 7 is a schematic cross-sectional view of the image forming apparatus of the embodiment 3.

Figure 8:
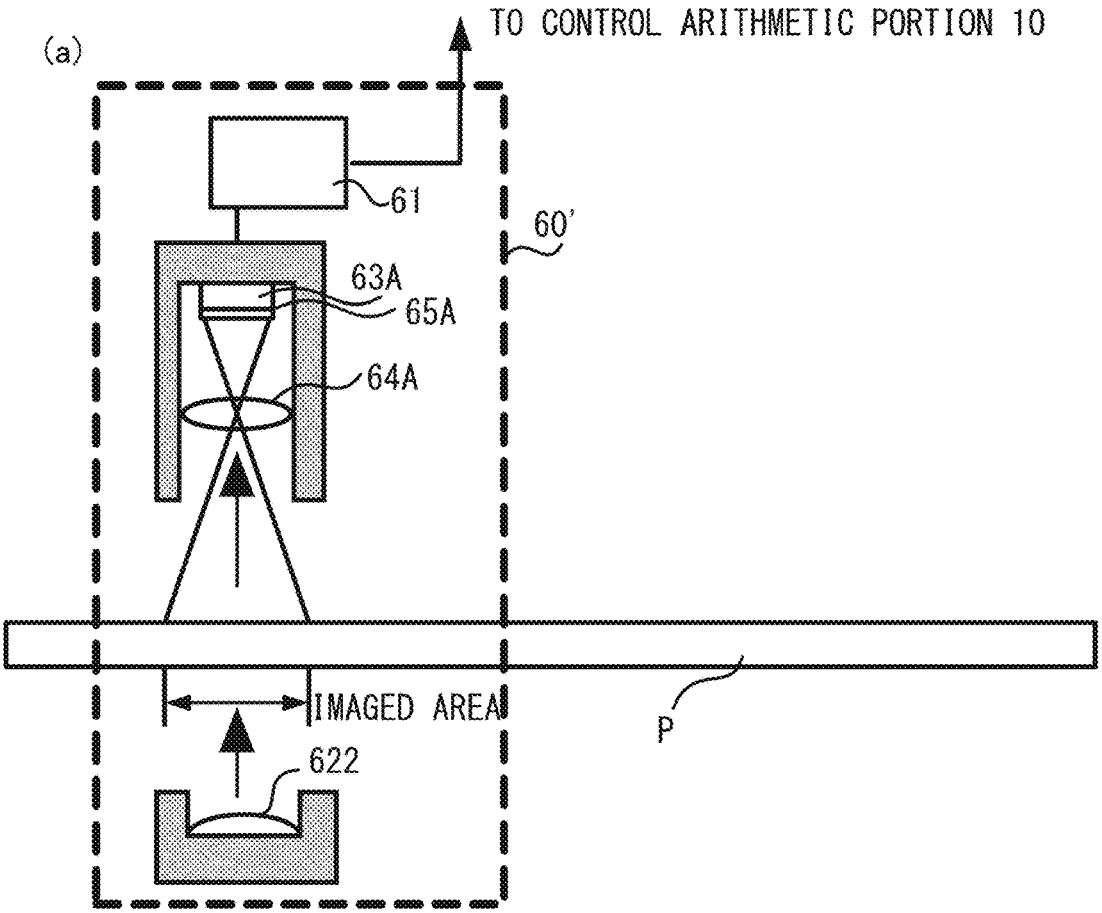

Part (a) of FIG. 8 is a schematic cross-sectional view of the thickness sensor in the embodiment 3, and part (b) of FIG. 8 is a drawing of the setting screen.

DESCRIPTION OF THE EMBODIMENTS

The following embodiment of the present invention is explained with reference to the drawings.

The Embodiment 1

[Multiple Image Forming Apparatuses Connected to the Network]

Figure 1:
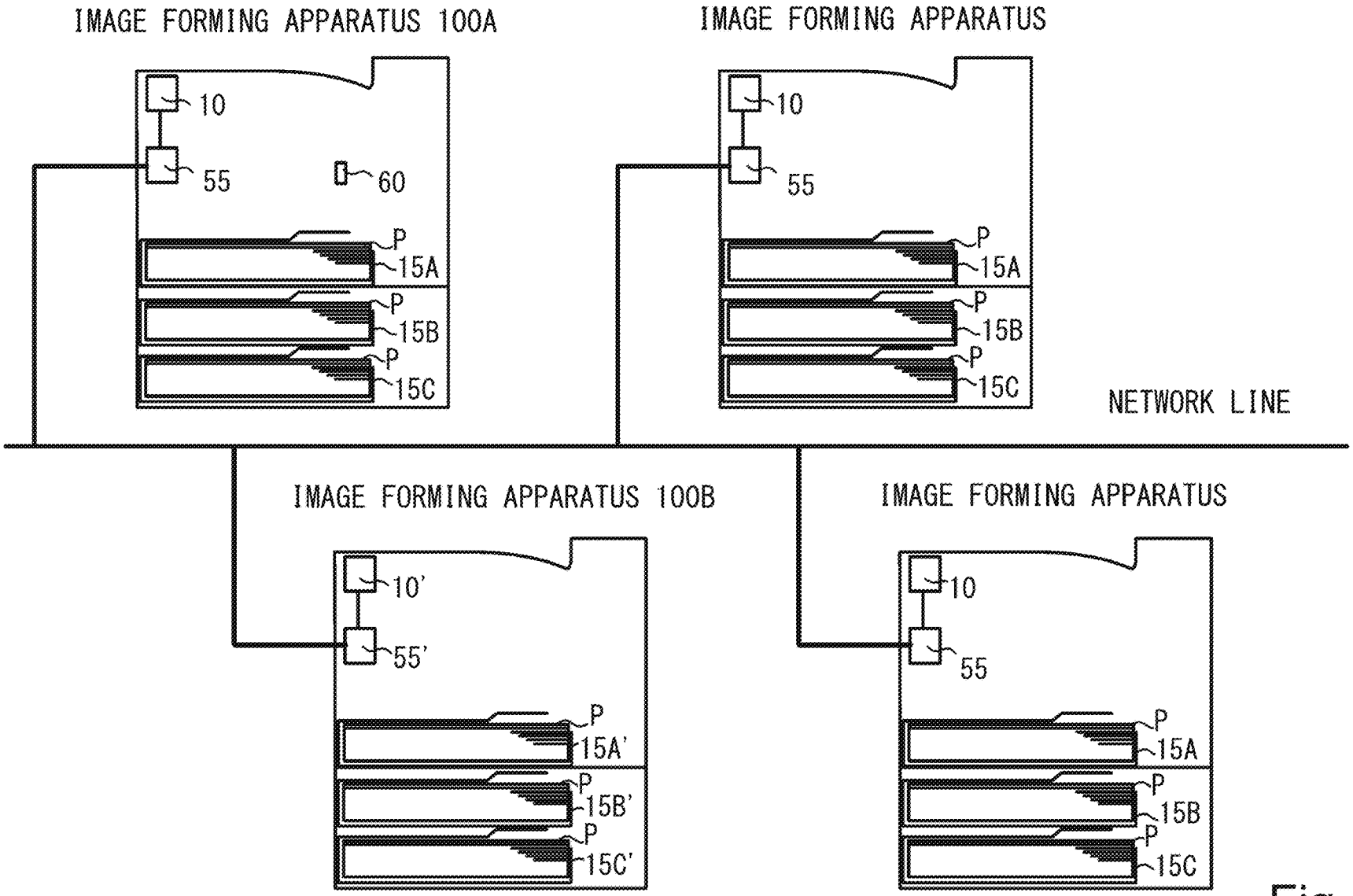
FIG. 1 is a drawing showing multiple image forming apparatuses connected to the network line in the embodiment 1.

In the embodiment 1, a plurality of image forming apparatuses are connected to a network line to form an image forming system. In the embodiment 1, a predetermined image forming apparatus obtains the characteristic value of the recording medium, which is the second information, from other image forming apparatuses connected via the network line, and a method for calculating the lifetime of the replaceable unit, for example, the feeding rotatable member involved in feeding the recording medium is described the lifetime of the replaceable unit, for example, the feeding rotatable member involved in transporting the recording medium. FIG. 1 shows a plurality of image forming apparatuses connected to a network line such as a LAN through a network connecting portion 55 (hereinafter referred to as "connecting portion 55") of the embodiment 1. For example, multiple image forming apparatuses such as image forming apparatus 100A, image forming apparatus 100B, . . . are connected to the network line. The plural image forming apparatuses 100A, 100B, . . . , etc. have a control arithmetic portion 10, a connecting portion 55, and a sheet feeding tray 15 (15A, 15B, 15C) for stacking paper P. Of these, the image forming apparatus 100A has a surface smoothness/thickness sensor 60 (described below), which is a detecting portion that detects the characteristic values of the recording medium, and the image forming apparatus 100B does not have a sensor, which is a detecting portion that detects the characteristic values of the recording medium.

[Structure of the Image Forming Apparatus]

Figure 2:
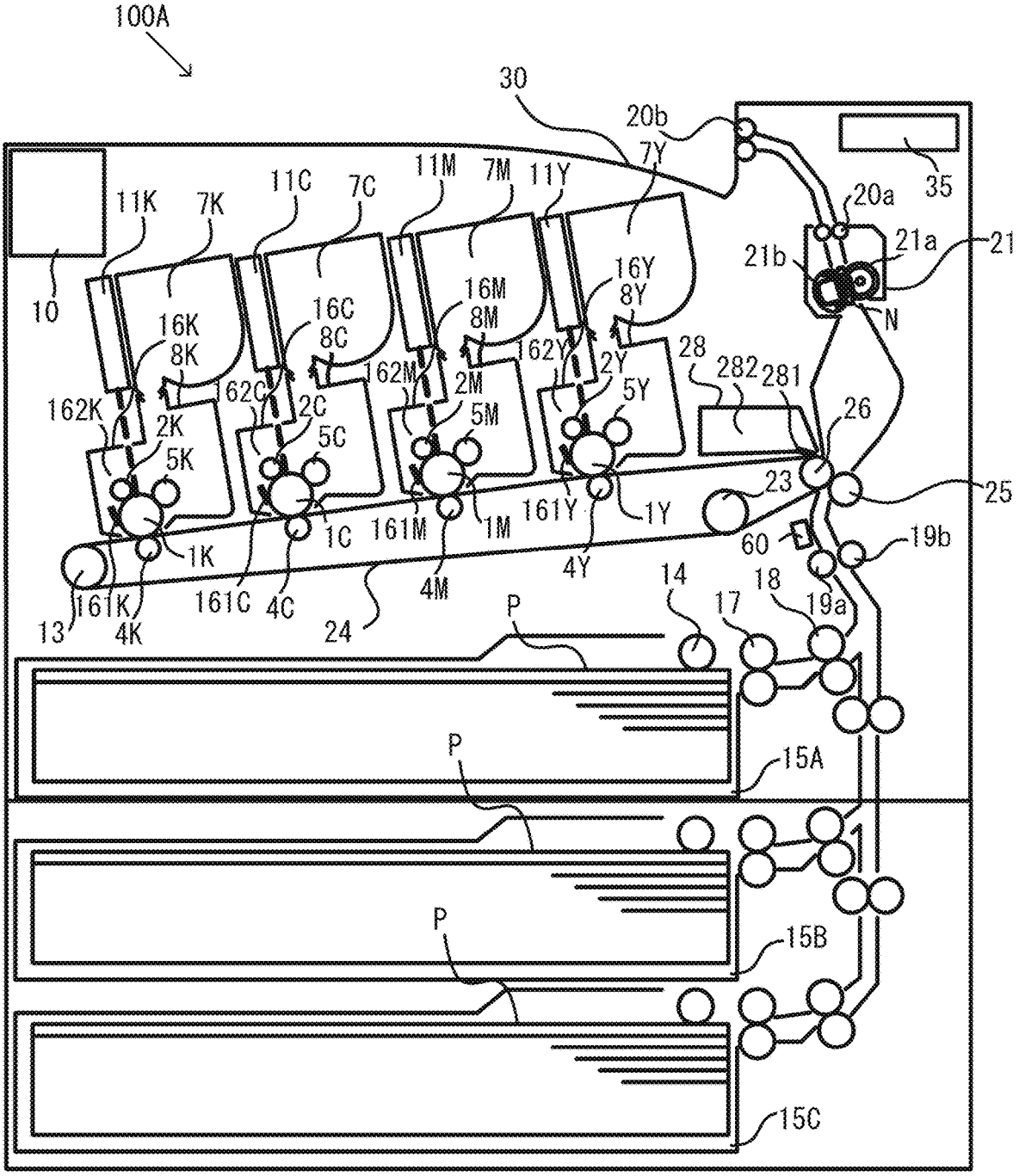
FIG. 2 is a schematic cross-sectional view of the image forming apparatus in the embodiment 1.

FIG. 2 shows a schematic cross-sectional view of the image forming apparatus 100A of the embodiment 1. In the embodiment 1, a color image forming apparatus adopting an intermediate transfer belt is described as an example of the image forming apparatus 100A, but an image forming apparatus having another configuration may be used. The structure of the image forming apparatus 100B is the same as that of the image forming apparatus 100A except that it does not have a detecting portion. Hence, the structure of image forming apparatus 100A, which has a detecting portion, is described.

The image forming apparatus 100A of the embodiment 1 is, for example, a four-drum full-color printer. Image forming apparatus 100A has photosensitive drums 1Y, 1M, 1C, and 1K, which are image carriers provided for each of yellow (Y), magenta (M), cyan (C), and black (K) stations. The subscripts Y, M, C, and K in the codes representing colors are omitted hereafter, except when a specific color is explained. The image forming apparatus 100A has a charging roller 2 as a charging means, an exposure scanner portion 11, a developer 8 as a developing means, a toner container 7 as a toner supply means, a drum cleaner 16, an intermediate transferring belt 24 as a rotating member, and a secondary transferring roller 24. Furthermore, the image forming apparatus 100A is equipped with a drive roller 26 that functions as an opposing roller for the secondary transfer roller 25 while driving the intermediate transferring belt 24, a tensioning roller 13, an auxiliary roller 23, a primary transfer roller 4, a fixing portion that is the fixing means. The image forming apparatus 100A is equipped with a control arithmetic portion 10, which is a control means for controlling and operating each of the above-mentioned members. The image forming apparatus 100A is equipped with at least one second stacking portion, the sheet feeding tray 15, and in FIG. 2, for example, has 3 sheet feeding trays, the sheet feeding tray 15A, the sheet feeding tray 15B, and the sheet feeding tray 15C.

The photosensitive drum 1 is composed of an aluminum cylinder with an organic photoconductive layer applied to its outer circumference, and rotates when the drive power of the drive motor (not shown) is transmitted to it. The drive motor rotates the photosensitive drum 1 in a clockwise direction, for example, according to the image forming operation. When the control arithmetic portion 10 receives an image signal, paper P, which is the recording medium, is fed from the sheet feeding tray 15A, for example, into the image forming apparatus 100A by the pickup roller 14 and the feeding rollers 17, 18. The paper P is once nipped between the feeding roller 19*a* and the feeding facing roller 19*b* (hereinafter referred to as "feeding roller pair 19*a*, 19*b*"), which are roller-like synchronous rotators for synchronizing the image forming operation and feeding of the paper P as described below, and then stops and waits. The feeding roller pairs 19*a* and 19*b* are also called registration roller pairs.

On the other hand, the control arithmetic portion 10 forms an electrostatic latent image according to the received image signal on the surface of the photosensitive drum 1 charged to a certain potential by the action of the charging roller 2 by the exhibit scanner portion 11. The developer 8 is a means to visualize the electrostatic latent image, and develops each color of YMCK at each station. Each developer 8 is equipped with a developing roller 5, to which a developing voltage is applied to visualize the electrostatic latent image. Thus, the electrostatic latent image formed on the surface of the photosensitive drum 1 is developed as a toner image of a single color (hereinafter referred to as a monochromatic toner image) by the action of the developer 8.

The intermediate transferring belt 24 is in contact with the photosensitive drums 1Y, 1M, 1C, and 1K, and rotates synchronously with the rotation of the photosensitive drums 1Y, 1M, 1C, and 1K in the counterclockwise direction when performing color image formation. The developed monochromatic toner image is sequentially transferred to the intermediate transferring belt 24 by the action of the primary transfer voltage applied to the primary transferring roller 4, and becomes a multi-color toner image (hereinafter referred to as multi-color toner image) on the intermediate transferring belt 24. The toner remaining on each photosensitive drum 1 that is not transferred to the intermediate transferring belt 24 is collected by the drum cleaner 16 set in contact with the photosensitive drum 1. The drum cleaner 16 has a cleaner blade 161 and a toner collection container 162.

The multi-color toner image formed on the intermediate transferring belt 24 is fed to the secondary transfer-nipping portion formed by the secondary transfer roller 25. At the same time, paper P, which has been waiting in the state of being held by the feeding roller pairs 19*a* and 19*b*, is fed by the feeding roller pairs 19*a* and 19*b* to the secondary transfer-nipping portion in synchronization with the multi-color toner image on the intermediate transferring belt 24. On the paper P fed to the secondary transfer-nipping portion (on the recording medium), the multicolor toner image is transferred in a batch by the secondary transfer voltage applied to the secondary transfer roller 25. The fixing portion 21 is roughly divided into a pressure roller 21*a* having an elastic layer and rotating, and a heating rotator 21*b* having a heating means that presses against the pressure roller 21*a* to form a fixing portion N and also heats the fixing portion N.

(Fixing Portion)

Part (a) of FIG. 3 shows a schematic structure cross-sectional view of the fixing portion 21 of the image forming apparatus 100A. The heat-resistant cylindrical heating film 211 that constitutes the heating rotor 21*b* is loosely fitted to the outer circumference of a support holder 212 that holds the heating film 211 in a cylindrical shape and a metal fixing stay 213 that holds the support holder 212. Furthermore, a plate-shaped heating element 214, which is a heating means, is held in the longitudinal direction of the support holder 212 (in the direction perpendicular to the paper surface), and by means of a pressurizing portion (not shown), the plate-shaped heating element 214 forms a fix-nipping portion N with a pressurizing roller 21*a* and a pressurizing pressure F through the heating film 211.

The heating film 211, which is nipped between the pressure roller 21*a* and the plate heating element 214, rotates with the pressure roller 21*a* around the support holder 212 and the fixing stay 213. A temperature sensor 215, which is a temperature detecting portion, is in contact with the inner surface of the heating film 211, and the inner surface temperature of the film is detected. The control arithmetic portion 10 controls the temperature of the heating film 211 to be a desired value based on the detection result of the temperature sensor 215. The heating film 211 of the embodiment 1 has a film 211B having, for example, a base layer of stainless steel material with a thickness of 35 μm. The heating film 211 has a 300 μm thick elastic layer 211R made of silicone rubber with thermal conductivity and a 25 μm thick mold-releasing layer 211S made of PFA material sequentially formed on the film 211B.

Back to the explanation of FIG. 2. The paper P holding the unfixed multi-color toner image is fed by the pressure roller 21*a*, and heat and pressure are applied at the fix-nipping portion N to fix the toner to the surface. After the toner image has been fixed, the paper P is discharged by the discharge roller pair 20*a*, 20*b* to the discharge tray 30, and the image forming operation is completed. The belt cleaner 28 cleans the toner remaining on the intermediate transferring belt 24 by the action of the cleaner blade 281, and the toner collected here is stored in the cleaner container 282. The image forming apparatus 100A of the embodiment 1 is equipped with a sheet feeding tray 15A provided in the main assembly of the image forming apparatus 100A, and a sheet feeding tray 15B and a sheet feeding tray 15C which are set as options.

The series of image forming operations described above are controlled by the control arithmetic portion 10 provided in the image forming apparatus 100A. The image forming apparatus 100A is equipped with a control panel 35 that serves as an input means for the user to input information and an output means for the user to receive information. The control arithmetic portion 10 is connected to the host computer (not shown) via the control panel 35 and the connecting portion 55. The control arithmetic portion 10 controls the image forming apparatus 100A according to the commands input from them. The control arithmetic portion 10 also has a function to notify the user of the status of the image forming apparatus 100A and each unit by means of an alert sound and message display, and a function to calculate the lifetime of the replaceable unit of the image forming apparatus 100A as described below. Furthermore, the control arithmetic portion 10 also functions as a memory means for storing and retaining the various characteristic values necessary for the calculation.

[Surface Smoothness/Thickness Sensor 60]

Part (b) of FIG. 3 is a schematic cross-sectional view showing the configuration of the first detecting portion, the surface smoothness/thickness sensor 60, which is an integrated configuration of the surface smoothness sensor and the thickness sensor, the detecting portion that detects the characteristic values of the paper P. The surface smoothness/thickness sensor 60 is equipped with an irradiation light emitting diode (hereinafter referred to as "LED") 621 as the first light irradiation means, an irradiation LED 622 as the second light irradiation means, a CMOS area sensor 63A as the imaging means, and an imaging lens 64A as the image forming means. Furthermore, the surface smoothness/thickness sensor 60 is equipped with a filtering portion 65A and a driving/arithmetic portion 61 that constitute the filtering means. The light that uses the irradiation LED 621 as a light source is blue light having a maximum wavelength of around 460 nm, and is irradiated toward the surface of the paper P (the imaged portion). The blue irradiation LED 621 is arranged to irradiate light at an angle of 45 degrees from the surface of the paper P, producing reflected light with a shade corresponding to the unevenness of the surface of the paper P. This reflected light is focused through the imaging lens 64A, and the wavelength component transmitted through the filtering portion 65A is imaged as a reflected light image on the CMOS area sensor 63A. The CMOS area sensor 63A outputs an image voltage signal to the driving/arithmetic portion 61 as an electrical signal that varies according to the amount of reflected light in each imaged area. When the drive/arithmetic portion 61 receives the image voltage signal output by the CMOS area sensor 63A, it converts the received signal into an analog-to-digital (hereinafter referred to as A/D) signal and outputs the converted digital signal of, for example, 256 shades to the control arithmetic portion 1 0.

On the other hand, the light source of the irradiation LED 622 is a red light with a maximum wavelength of around 640 nm, for example, and is irradiated toward the surface of the paper P opposite to the surface of the paper P irradiated by the irradiation LED 621 (the imaged portion). The red irradiation LED 622 is arranged to irradiate light from the direction normal to the paper surface of the paper P, and the light is transmitted with an attenuation amount corresponding to the thickness of the paper P. This transmitted light is also focused through the imaging lens 64A, and the wavelength component transmitted through the filtering portion 65A is imaged as a transmitted light image on the CMOS area sensor 63A, and the image voltage signal as an electrical signal that varies according to the amount of transmitted light is output to the drive/arithmetic portion 61. Then, in the same way, the drive/arithmetic portion 61 converts the image voltage signal into a digital signal of 256 shades and outputs it to the control arithmetic portion 10. The control arithmetic portion 10 can obtain the surface smoothness value and thickness value used in part (a) of FIG. 4 below in the above manner.

As shown in FIG. 2, the surface smoothness/thickness sensor 60 of the embodiment 1 is set on the feeding path between the feeding roller pairs 19*a*, 19*b* and the secondary transferring portion. The position where the surface smoothness/thickness sensor 60 is set can be any place where the characteristics of the paper P can be detected. The surface smoothness/thickness sensor 60 detects information on the unevenness of the surface of the paper P (hereinafter referred to as surface smoothness) and information on the thickness of the paper P when the paper P is fed to the secondary transferring portion, in other words, before the toner image is transferred to the paper P. Then, the surface smoothness/thickness sensor 60 outputs the detection results to the control arithmetic portion 10. The control arithmetic portion 10 memorizes the results detected by the surface smoothness/thickness sensor 60 as characteristic values for each paper P stacked on each sheet feeding tray 15. In other words, each sheet feeding tray 15 and the characteristic value of the paper P stacked on each sheet feeding tray 15 are memorized in association with each other. The control arithmetic portion 10 calculates the lifetime of the replaceable unit based on the stored characteristic values for each sheet of paper P. The method of calculating the lifetime of the replaceable unit is described later.

However, the measurement value measured by the surface smoothness/thickness sensor 60 is affected by the unevenness of the paper P, lot differences, and detection variations of the measuring instrument. In the embodiment 1, after the control arithmetic portion 10 detects that paper P has been stacked on the sheet feeding tray 15, it measures with the surface smoothness/thickness sensor 60 for 10 sheets, obtains the average value of the measurement results for 10 sheets of paper P, and memorizes the average value as a characteristic value.

[Lifetime Calculation of Replaceable Unit]

The following is an explanation of the method of predicting the degree of deterioration (hereinafter referred to as the degree of deterioration) for fixing portion 21, an example of the replaceable unit in the embodiment 1, and calculating the lifetime of fixing portion 21 based on the predicted value. The lifetime of the fixing portion 21 is accelerated by the wear of the mold-releasing layer 211S of the heating film 211, which is a feeding rotatable member, and as the fixing portion 21 approaches the end of its lifetime, image defects occur. In the image forming apparatus 100A, in the control arithmetic portion 10, the standard value Wps of the amount of wear of the release layer 211S due to feeding paper P (hereinafter referred to as paper feeding) is $0.84\times10^{-4}$ μm per page (per sheet). In the actual use environment of a user rather than in an endurance test, it may be possible to improve the accuracy of the prediction calculation by using the amount of wear per unit rotation of the heating film 211 as a standard rather than the amount of wear per unit page as described above. Therefore, in the embodiment 1, the number of rotations of the heating film 211 actually measured is also measured, and the amount of wear is calculated, accumulated, and retained by setting the standard value Wrs of the amount of wear per rotation as $0.17\times10^{-5}$ μm. The accumulated amount of wear is referred to as the accumulated amount of wear W. The number of rotations of the heating film 211 is detected by a known detection method, such as detection using an encoder or a method for determining the number of rotations based on the rotation speed and the drive time.

The control arithmetic portion 10 performs the lifetime calculation to obtain the remaining lifetime, which indicates in percentage how close the accumulated wear amount W is to the predetermined lifetime value of the heating film 211. As mentioned above, the thickness of the release layer 211S of the heating film 211 used in the embodiment 1 is 25 μm. If the thickness of the release layer 211S of the heating film 211 becomes extremely thin due to progressive wear of the release layer 211S of the heating film 211 by use of the image forming apparatus 100A, small cracks may occur in the release layer 211S and the release effect may not be sufficiently demonstrated and the image quality may be degraded. Therefore, in the embodiment 1, the lifetime value Wm of the integrated wear amount W is set to 23 μm, and the control arithmetic portion 10 performs the lifetime calculation according to the following formula (1).

$$\text{remaining lifetime}(\%)=(1-(\text{accumulated wear amount } W[\mu m]/\text{lifetime value } WM[\mu m]))\times100 \quad \text{formula} \tag{1}$$

According to formula (1), when the accumulated wear amount W is 0, the remaining lifetime is 100%, and the state of the heating film 211 (or fixing portion 21) at this time is called new. When the accumulated wear amount W becomes equal to the lifetime value Wm, the remaining lifetime is 0%, and the state of the heating film 211 (or fixing portion 21) at this time is called out of lifetime. The calculation result of the remaining lifetime (%) is displayed on the control panel 35 and notified to the user.

By the way, it is known that the amount of wear of the mold-releasing layer 211S of the heating film 211 varies depending on the surface smoothness and thickness of the paper P being subjected to passing. The inventors have investigated this and found that the amount of wear of the release layer 211S can be accurately predicted by considering the surface smoothness and thickness of the paper P. The rougher the surface smoothness of the paper P and the thicker the thickness of the paper P, the larger the amount of wear per unit page. Therefore, in the embodiment 1, the surface smoothness and thickness of the paper P are used as characteristic values in the prediction calculation of the replaceable unit, specifically, the degree of deterioration of the mold-releasing layer of the heating film 211.

The control arithmetic portion 10 calculates the amount of wear of the release layer 211S of the heating film 211 as a predicted calculation value of the degree of deterioration, and corrects it according to the surface smoothness and thickness of the paper P detected by the surface smoothness/thickness sensor 60. In other words, the control arithmetic portion 10 accumulates and retains the amount of wear for each sheet of paper and for each rotation of the heating film 211. Here, as described above, the standard value Wps of the amount of wear of the release layer 211S due to paper feeding is $0.84\times10^{-4}$ μm per page, and the standard value Wrs of the amount of wear is $0.17\times10^{-5}$ μm per one rotation of the heating film 211.

(Correction Factor Matrix)

The image forming apparatus 100A of the embodiment 1 has a matrix of correction factors (hereinafter referred to as the correction matrix) in the control arithmetic portion 10 according to the characteristic values of the paper P, as shown in part (a) of FIG. 4. Part (a) of FIG. 4 shows the surface smoothness vertically and the thickness horizontally. The control arithmetic portion 10 obtains a correction factor P(S) of 0.6 to 1.4 from the correction factor matrix based on the surface smoothness and thickness of the paper P stacked in each sheet feeding tray 15A to 15C identified by the method described above. For example, if the surface smoothness and thickness are detected as 30 and 0.1, respectively, by the surface smoothness/thickness sensor 60, the control arithmetic portion 10 obtains the correction factor P(S) as 0.9 from part (a) of FIG. 4. The control arithmetic portion 10 determines the amount of wear per page by multiplying the aforementioned standard value ($0.84\times10^{-4}$ μm) by the correction factor P(S) and then accumulates it for each page, as shown in the following formula (2).

$$\text{accumulated wear amount } W(\mu m)=\Sigma(\text{standard value}\times P(S)) \quad \text{formula (2)}$$

The correction factor P(S) shown in part (a) of FIG. 4 is smaller the smaller the surface smoothness and the thinner the thickness of the paper P is. This makes it possible to determine the amount of wear of the release layer 211S of the heating film 211, taking into account the surface smoothness and thickness of the paper P.

The amount of wear caused by paper feeding from each sheet feeding tray 15A to 15C is calculated individually as the amount of wear Wa, Wb, and Wc using formula (2). Here, the wear amount Wa is the wear amount caused by the paper P fed from sheet feeding tray 15A, the wear amount Wb is the wear amount caused by the paper P fed from sheet feeding tray 15B, and the wear amount Wc is the wear amount caused by the paper P fed from sheet feeding tray 15C. The total wear amount W can be calculated according to the following formula (3).

$$W=Wa+Wb+Wc \quad \text{formula (3)}$$

In the embodiment 1, information on the surface smoothness and thickness of the paper P is detected by capturing the reflected light and transmitted light by the CMOS area sensor 63A, as shown in part (b) of FIG. 3, respectively. However, the detecting portions applicable to the present invention are not limited to these. For example, an ultrasonic sensor that recognizes the surface condition and thickness of the recording medium by irradiating the recording medium with ultrasonic waves and detecting the reflectance and transmittance thereof, and other sensors of various methods can be used alone or in combination.

[Acquisition of Characteristic Values of Paper by Image Forming Apparatus without Detecting Portion]

In the embodiment 1, the first image forming apparatus, image forming apparatus 100B, does not have a detecting portion. The image forming apparatus 100B acquires the characteristic values of the paper P to be used for the lifetime calculation from the image forming apparatus 100A, which is the other image forming apparatus (or the second image forming apparatus) having the detecting portion among the multiple image forming apparatuses connected via the network line. For the image forming apparatus 100B, the same sign is used for the member that is common to the image forming apparatus 100A, and the sign is suffixed with "'" is added to the end of the sign to distinguish it from the member of image forming apparatus 100A.

TABLE 1

| TRAY | PAPER KIND |
|---|---|
| IMAGE FORMING APPARATUS 100A | |
| FEEDING TRAY 15A | RECORDING MEDIUM A |
| FEEDING TRAY 15B | RECORDING MEDIUM B |
| FEEDING TRAY 15C | RECORDING MEDIUM C |
| IMAGE FORMING APPARATUS 100B | |
| FEEDING TRAY 15A' | RECORDING MEDIUM A |
| FEEDING TRAY 15B' | RECORDING MEDIUM A |
| FEEDING TRAY 15C' | RECORDING MEDIUM C |

Table 1 shows examples of paper types of paper P stacked in each sheet feeding tray 15 of image forming apparatus 100A and image forming apparatus 100B. Table 1 shows the tray name in the first column and the paper type in the second column. For example, sheet feeding tray 15A of image forming apparatus 100A is stacked with recording material A, sheet feeding tray 15B is stacked with recording material B, and sheet feeding tray 15C is stacked with recording material C. On the other hand, the sheet feeding tray 15A' and 15B' of the image forming apparatus 100B are stacked with the same recording material A as the sheet feeding tray 15A of the image forming apparatus 100A, and the sheet feeding tray 15C' is stacked with the same recording material B as the sheet feeding tray 15B of the image forming apparatus 100A. The recording material A stacked on the sheet feeding tray 15A of the image forming apparatus 100A, the recording material B stacked on the sheet feeding tray 15B, and the recording material C stacked on the sheet feeding tray 15C correspond to the second recording medium. The recording material A stacked on the sheet feeding tray 15A' and 15B' and the recording material B stacked on the sheet feeding tray 15C' of the image forming apparatus 100B correspond to the first recording medium.

[Settings]

In an MPS environment, it is common for an administrative user to manage multiple image forming apparatuses, including paper P, and to use the same paper type in those image forming apparatuses. As shown in Table 1, for example, recording material A and recording material B are used in both image forming apparatus 100A and image forming apparatus 100B. The administrative user knows the paper type stacked in the image forming apparatus 100A. Therefore, when connecting the image forming apparatus 100B to the network line, the administrator uses the setting menu shown in part (b) of FIG. 4 from the control panel 35' of the image forming apparatus 100B to make the following settings. Part (b) of FIG. 4 shows the screen on which the menu for managing and setting the parameters related to paper P is displayed.

As described above, in the image forming apparatus 100A, each sheet feeding tray 15 and the characteristic values of the paper P stacked on each sheet feeding tray 15 are associated and memorized in the control arithmetic portion 10. The administrative user sets the characteristic values of the paper P (recording material A) stacked on the sheet feeding tray 15A stored by the image forming apparatus 100A to be acquired as the characteristic values of the paper P stacked on the sheet feeding tray 15A'. In the same way, the administrative user sets the sheet feeding tray 15B' to acquire the characteristic value of the recording material A of the sheet feeding tray 15A of the image forming apparatus 100A, and the sheet feeding tray 15C's sheet feeding tray 15B's sheet feeding tray 15B of the image forming apparatus 100A, respectively. As a result, the control arithmetic portion 10 obtains the printer name and tray number, which are the first information about the other image forming apparatus (in this case, image forming apparatus 100A) connected to the network line. The printer name and tray number are associated with the sheet feeding tray 15A'-15C' respectively. The printer name is an example of information that identifies other image forming apparatuses connected to the network line, and the tray number is an example of information that identifies the sheet feeding tray 15, which may be, for example, an identification number. In this way, the control arithmetic portion 10 also functions as a setting means.

Part (b) of FIG. 4 shows the setting menu and setting values displayed on the control panel 35' of the image forming apparatus 100B. The figure also shows how the printer name (image forming apparatus 100A) and the tray number (sheet feeding tray 15A, etc.) of the referenced printer are associated with each tray of sheet feeding tray 15A', 15B', and 15C'. Here, when the OK button is pressed, the information set in the setting menu is memorized in the control arithmetic portion 10', for example. As described above, each sheet feeding tray 15', which is the first stacking portion of the image forming apparatus 100B, is associated with each sheet feeding tray 15 of the image forming apparatus 100A. In this way, the control arithmetic portion 10 can set up other stacking portions in association with the first stacking portion.

In the image forming apparatus 100B, the control arithmetic portion 10' calculates the lifetime of the fixing portion 21' (specifically, the release layer 211S' of the heating film 211') in the same manner as in the image forming apparatus 100A described above. In this case, by using the characteristic values of the paper P obtained from the image forming apparatus 100A in which the control arithmetic portion 10' has a detecting portion, it is possible to calculate the lifetime with good accuracy. In the embodiment 1, we have described two image forming apparatuses connected via a network line, but it is also applicable to cases where more than two image forming apparatuses are connected. When multiple image forming apparatuses are connected, the information of the image forming apparatus and sheet feeding tray for which the characteristic values are to be acquired can be set from the control panel of each image forming apparatus that does not have a detecting portion.

According to the embodiment 1, it is not necessary for all the image forming apparatuses connected via the network line to have a detecting portion that detects the characteristic value of the recording medium. In addition, even when the paper type provided by the administrative user is changed, since the paper type itself is not set, the administrative user does not need to change the settings of multiple image forming apparatuses that do not have detecting portions, thereby making it possible to reduce the burden of management. In the embodiment 1, image forming apparatus 100A and image forming apparatus 100B are described as having the same configuration. However, if the image forming apparatuses have different configurations, it is possible to calculate the lifetime with high accuracy by using the values corresponding to the configuration of each image forming apparatus for the lifetime value Wm and the standard values Wps and Wrs of the accumulated wear amount W used in formulas (1) and (2) to calculate the lifetime. Furthermore, in the embodiment 1, surface smoothness and thickness are used as characteristic values for lifetime calculation, but the characteristic values are not limited to these. For example, the correction factor P(S) as used in formula (2) may be used as the characteristic value of the recording medium, instead of using the result detected by the detecting portion as the characteristic value.

As described above, the embodiment 1 makes it possible to accurately calculate the lifetime of an image forming apparatus that does not have a detecting portion to detect the characteristics of the recording medium. In addition, it is possible to suppress the price increase of image forming apparatus and to reduce the burden of management for administrative users. According to the above the embodiment 1, the lifetime of replaceable unit can be predicted accurately even for the image forming apparatus which does not have the means to detect the characteristics of recording medium.

The Embodiment 2

In the embodiment 2, the image forming apparatus with the detecting portion identifies the brand name of the recording medium from a list prepared in advance based on the detection results of the recording medium. This section describes the method in which the image forming apparatus in the embodiment 2 obtains the characteristic values of the recording medium associated with the brand name, which cannot be detected by the detecting portion, through the network line and performs the lifetime calculation.

[Regarding the Amount of Filler and Stiffness]

The inventors examined the results and found that the amount of wear of the release layer 211S of the heating film 211 can be predicted more accurately by considering the stiffness of the recording medium and the amount of filler contained in the recording medium (hereinafter referred to as the filler content). The higher the stiffness of the recording medium and the higher the amount of filler contained in the recording medium, the greater the amount of wear per unit page. In the case of ordinary copy paper, the main component of the filler is calcium carbonate, but it also includes silica, titanium dioxide, talc, and clay. Therefore, in the embodiment 2, the stiffness of the recording medium and the amount of filler contained in the recording medium are used as characteristic values when calculating the prediction of the degree of deterioration of the feeding rotatable member.

However, it is difficult to measure the stiffness and filler content of the recording medium with the sensor of the image forming apparatus in general, and there is a possibility that it cannot be detected. The image forming apparatus of the embodiment 2 has the information of the brand name, characteristic values, and the list of representative values of detection results by the detecting portion for the recording medium provided by the administrative user as shown in Table 2 in the control arithmetic portion 10.

TABLE 2

| RECORDING MEDIUM | THICK-NESS | SURFACE SMOOTH-NESS | STIFF-NESS (mN) | FILLER CONTENT (%) |
|---|---|---|---|---|
| A | 0.105 | 24.54 | 96.91 | 16.52 |
| B | 0.102 | 32.88 | 109.12 | 21.31 |
| C | 0.093 | 26.44 | 88.18 | 25.35 |
| D | 0.108 | 29.29 | 106.19 | 19.41 |
| E | 0.104 | 31.14 | 90.25 | 17.82 |
| F | 0.094 | 135.76 | 101.62 | 16.38 |
| G | 0.111 | 577.80 | 85.15 | 38.74 |

Here, Table 2 shows the brand name of paper P (recording medium A, etc.) in the first column, the thickness of paper P in the second column, the surface smoothness in the third column, the stiffness (mN) in the fourth column, and the filler content (%) in the fifth column. For example, when the brand name of paper P is recording medium D, the thickness is 0.108, the surface smoothness is 29.29, the stiffness is 106.19 mN, and the filler content is 19.41%. As shown in Table 2, the information that associates the brand name of paper P with the thickness, surface smoothness, stiffness, and filler content is hereinafter referred to as the recording medium list.

[Lifetime Calculation of Replaceable Unit]

The control arithmetic portion 10 identifies the brand of paper P being used based on the detection results by the detecting portion and the information in Table 2, and calculates the lifetime of the fixing portion 21 in the same way as in the embodiment 1 using the characteristic values of stiffness and filler content. The rest of the configuration is the same as that of the image forming apparatus in the embodiment 1.

The recording medium list shown in Table 2 stores information on the surface smoothness and thickness detected by the surface smoothness/thickness sensor 60 as representative values of the detection results from the detecting portion of the paper P. In the recording medium list, the stiffness and filler content, which are characteristic values that cannot be detected by the surface smoothness/thickness sensor 60 of the image forming apparatus 100, are also stored. In the embodiment 2, the amount of filler content was determined using the ash content test method described in JIS P8251. In addition to this, for example, the blended amounts of the aforementioned various fillers may be calculated for each component using a quantitative analysis method using X-ray fluorescence, and the sum of these amounts may be used as the blended amount. It is also possible to focus on a specific component and use it as the blending amount. As the method of measuring the stiffness of paper P in this study, the Clarke stiffness tester method described in JIS P8143 was adopted. However, the stiffness of paper P may be measured using other methods that correlate with the Clarke stiffness, such as the Gahle method of Japan TAPPI No. 40, the Taber stiffness tester method of JIS P8125, or the simple method of TAPPI UM409. It is believed that the same correlation with the amount of wear of the release layer 211S of the heating film 211 can be obtained even when measured using these other methods.

The image forming apparatus 100A of the embodiment 2 outputs the detection results of the surface smoothness and thickness of the paper P to the control arithmetic portion 10 by the surface smoothness/thickness sensor 60 described above. The control arithmetic portion 10 identifies the stiffness and filler content of the paper P based on the detection results of the surface smoothness/thickness sensor 60 and the recording medium list in Table 2, and performs a lifetime calculation.

The control arithmetic portion 10 of the image forming apparatus 100A of the embodiment 2 obtains a correction factor P'(S) of 0.5 to 1.6 from the correction factor matrix shown in FIG. 5 when calculating the aforementioned accumulated wear W. FIG. 5 shows the amount of filler content (%) vertically and the Clark stiffness horizontally. For example, if the amount of filler is 20% and the Clarke stiffness is 130 according to the detection results of the surface smoothness/thickness sensor 60 and the recording medium list in Table 2, the control arithmetic portion 10 obtains a correction factor P'(S) of 1.1 from FIG. 5. Then, the control arithmetic portion 10 multiplies the amount of wear per page by the aforementioned standard value and then accumulates it for each page, as shown in the following formula (4).

$$\text{accumulated wear amount } W(\mu m)=\Sigma(\text{standard value}\times P'(S)) \qquad \text{formula (4)}$$

The correction factor P'(S) is smaller the lower the stiffness of the paper P and the lower the filler content.

In the embodiment 2, when an administrative user changes the paper type provided to the user, the control arithmetic portion 10 determines that the paper P has been changed, and checks the detection result against the recording medium list to obtain the stiffness and filler content required for the lifetime calculation from the recording medium list. Then, the arithmetic portion 10 obtains the new correction factor P'(S) (the new correction factor is also called P (SNew)) after the paper type is changed from the correction factor matrix shown in FIG. 5, and the lifetime calculation with high accuracy can be performed. The rest of the procedure is the same as in the embodiment 1.

[Acquisition of Characteristic Values of Paper by Image Forming Apparatus without Detecting Portion]

In the embodiment 2, when connecting the image forming apparatus 100B to the network line, the administrative user performs the following actions. In other words, from the control panel 35' of the image forming apparatus 100B sets which sheet feeding tray 15' of the image forming apparatus 100A is used to acquire the characteristic values of the paper P stacked on the sheet feeding tray 15' of the image forming apparatus 100A (see part (b) of FIG. 4). In the embodiment 2, the characteristic values to be acquired are the characteristic values (e.g., filler content, Clarke stiffness, etc.) to be used for the lifetime calculation, which are specified based on the results of the detection of the paper P stacked in each sheet feeding tray 15 by the image forming apparatus 100A and the recording medium list in Table 2.

According to the embodiment 2, the image forming apparatus 100B can calculate the lifetime with high accuracy by using the characteristic values of the recording medium obtained from the image forming apparatus 100A when calculating the aforementioned lifetime. Since the image forming apparatus 100B does not need to have a detecting portion to detect the characteristic values of the recording medium and memory means to memorize the recording medium list of the recording medium, the price increase can be suppressed. In addition, when updating the recording medium list of the recording medium, the administrative user only needs to update the recording medium list of the image forming apparatus 100A, which reduces the burden of management.

As described above, the embodiment 2 makes it possible to accurately calculate the lifetime of an image forming apparatus that does not have a detecting portion to detect the characteristics of the recording medium. In addition, it is possible to suppress the price increase of image forming apparatus and to reduce the burden of management for users. According to the above the embodiment 2, the lifetime of replaceable unit can be predicted accurately even for the image forming apparatus which does not have the means to detect the characteristics of recording medium.

The Embodiment 3

The embodiment 3 describes a configuration in which there are multiple image forming apparatuses that are connected via a network line and have different numbers of characteristic values that can be detected by the detecting portion. Among the multiple image forming apparatuses, the image forming apparatus with the detecting portion that has a smaller number of characteristic values that can be detected by the detecting portion acquires the characteristic values of the recording medium from the image forming apparatus with the detecting portion which can detect more characteristic values.

[Multiple Image Forming Apparatuses Connected to the Network]

FIG. 6 shows multiple image forming apparatuses connected to the network line via the connecting portion 55 of the embodiment 3. Of these, the image forming apparatus 100A has a surface smoothness/thickness sensor 60 as the first detecting portion that detects the characteristic values of the paper P. On the other hand, the image forming apparatus 100C has a thickness sensor 60', which can detect fewer characteristic values than the surface smoothness/thickness sensor 60, as the second detecting portion to detect the characteristic values of the paper P.

[Structure of the Image Forming Apparatus]

FIG. 7 is a schematic cross-sectional view of the image forming apparatus 100C of the embodiment 3. The image forming apparatus 100C is similar to the image forming apparatus 100A described in the embodiment 1, except that it has a thickness sensor 60' and the sheet feeding tray is one of the sheet feeding trays 15A'. For the image forming apparatus 100C, the same sign is used for the member in common with the image forming apparatus 100A, and in the following explanation, the sign is suffixed with "'" to distinguish it from the member of the image forming apparatus 100A. In addition, as in the embodiment 1, the surface smoothness and thickness of the paper P are used as characteristic values in the calculation of the lifetime.

[Thickness Sensor 60]

Part (a) of FIG. 8 is a schematic cross-sectional view of the thickness sensor 60'. The thickness sensor 60' is a sensor in which the surface smoothness sensor is deleted from the surface smoothness/thickness sensor 60 shown in part (b) of FIG. 3 in order to reduce the size and cost of the sensor. In other words, the thickness sensor 60' does not have the irradiation LED 621, which is the first light irradiation means. The measurement principle of the thickness sensor 60' is the same as the principle of thickness measurement in the surface smoothness/thickness sensor 60 described above. For example, a small thickness sensor 60' can be mounted on a small image forming apparatus that is intended to be used on a personal tabletop.

The image forming apparatus 100C outputs the information of the thickness of the paper P to the control arithmetic portion 10 by means of the thickness sensor 60'. The control arithmetic portion 10 can use the thickness of the paper P as a characteristic value and perform a lifetime calculation based on a single characteristic value. However, compared to the case where the lifetime calculation is performed using two characteristic values, the surface smoothness and the thickness, as in the embodiment 1, it is not possible to perform the lifetime calculation with high accuracy.

[Acquisition of Paper Characteristic Values by Image Forming Apparatus 100C]

The method by which the image forming apparatus 100C, which has a thickness sensor 60 that can detect a small number of characteristic values, acquires characteristic values of paper P from the image forming apparatus 100A, which has a surface smoothness/thickness sensor 60 that can detect a large number of characteristic values, is a feature of the embodiment 3. When the administrator connects the image forming apparatus 100C to the network line, the user performs the following operations. In other words, the user acquires the characteristic values of the paper P stacked on the sheet feeding tray 15A' of the image forming apparatus 100C from the image forming apparatus 100A connected via the network line. The setting menu is available from the control panel 35' of the image forming apparatus 100C. The setting menu will be described later.

TABLE 3

| TRAY | PAPER KIND |
|---|---|
| IMAGE FORMING APPARATUS 100A | |
| FEEDING TRAY 15A | RECORDING MEDIUM A |
| FEEDING TRAY 15B | RECORDING MEDIUM B |
| FEEDING TRAY 15C | RECORDING MEDIUM C |
| IMAGE FORMING APPARATUS 100C | |
| FEEDING TRAY 15A' | RECORDING MEDIUM A |
| — | — |
| — | — |

Table 3 shows examples of the paper types stacked in each sheet feeding tray 15 of the image forming apparatus 100A and sheet feeding tray 15A' of the image forming apparatus 100C. For example, the sheet feeding tray 15A of the image forming apparatus 100A is stacked with recording material A, the sheet feeding tray 15B is stacked with recording material B, and the sheet feeding tray 15C is stacked with recording material C. On the other hand, sheet feeding tray 15A' of image forming apparatus 100C is stacked with recording material A. In such a case, the administrative user can use the control panel 35' of the image forming apparatus 100C to acquire the characteristic values of the paper P in the sheet feeding tray 15A' from the image forming apparatus 100A, as shown in part (b) of FIG. 8. Here, part (b) of FIG. 8 shows the screen on which the menu for managing and setting the parameters related to the paper P is displayed.

Part (b) of FIG. 8 shows how the name of the referenced printer (image forming apparatus 100A) has been set in the tray settings of sheet feeding tray 15A' for image forming apparatus 100C. Here, when the OK button is pressed, the information set in the setting menu is memorized in the control arithmetic portion 10', for example. As described above, the sheet feeding tray 15A' of the image forming apparatus 100C and the image forming apparatus 100A are associated and memorized.

The control arithmetic portion 10' of the image forming apparatus 100C transmits the thickness information of the recording material stacked on the sheet feeding tray 15' detected by the thickness sensor 60' to the image forming apparatus 100A set on the control panel 35' via the connecting portion 55'. As described above, in the image forming apparatus 100A, each sheet feeding tray 15 and the characteristic value of the paper P stacked on each sheet feeding tray 15 are associated and memorized in the control arithmetic portion 10. The control arithmetic portion 10 of the image forming apparatus 100A compares the information on the thickness of the paper P received from the image forming apparatus 100C with the information on the thickness of the paper stacked in each sheet feeding tray 15A of the image forming apparatus 100A stored in the control arithmetic portion 10. Then, the control arithmetic portion 10 identifies the recording material A that has the same thickness among the information. After identifying the recording material A, the control arithmetic portion 10 transmits the memorized information on the surface smoothness of the recording material A to the image forming apparatus 100C via the connecting portion 55. The control arithmetic portion 10' of the image forming apparatus 100C links the information on the surface smoothness of the recording material A received from the image forming apparatus 100A with the sheet feeding tray 15A' and memorizes it.

When calculating the aforementioned lifetime, the image forming apparatus 100C uses the information on the surface smoothness of the recording material A obtained from the image forming apparatus 100A and the information on the thickness of the recording material A detected by the thickness sensor 60' as characteristic values lifetime calculation which makes it possible to calculate the service lifetime with high accuracy. Also, the image forming apparatus 100C has a thickness sensor 60'. For example, when supplying paper P, there is a case where the user supplies paper P of a different paper type from that stacked in the sheet feeding tray 15A' (hereinafter referred to as an erroneous stacking). When such the erroneous stacking occurs, the control arithmetic portion 10' can detect that the paper type of the paper P is different before and after the replenishment based on the results of detecting the thickness of the paper P by the thickness sensor 60'. When the wrong paper type is detected, the control arithmetic portion 10' displays on the control panel 35' that a different paper type has been stacked, and prompts the user to stack the correct paper type. Along with this, the control arithmetic portion 10' obtains the information on the surface smoothness of the paper P from the image forming apparatus 100A by the method described above, and performs the lifetime calculation.

As described above, the embodiment 3 makes it possible to accurately calculate the lifetime of an image forming apparatus that has a detecting portion with a small number of characteristic values to be detected. In addition, it is possible to detect the erroneous stacking, notify the user, acquire new characteristic values for the paper type of the erroneously stacked paper P, and perform the lifetime calculation based on the acquired characteristic values.

In the embodiment 3, the image forming apparatus 100C acquires the information of the surface smoothness of the paper P from the image forming apparatus 100A. However, it is also possible that the image forming apparatus 100A has a recording medium list as in the embodiment 2, and acquires the information on stiffness and filler content from the image forming apparatus 100A to perform the lifetime calculation. It may also be configured to perform the lifetime calculation by acquiring the correction factor P(S) calculated by the image forming apparatus 100A as information on the characteristic values. For example, if the image forming apparatus 100C has multiple sheet feeding trays 15' and multiple image forming apparatuses with surface smoothness/thickness sensors 60 are connected to the network line, the following is possible. For example, the control panel 35' of the image forming apparatus 100C can be set to acquire the characteristic values of paper P from a different image forming apparatus for each sheet feeding tray 15'. In other words, sheet feeding tray 15B', sheet feeding tray 15C' . . . can be added to the empty spaces in the tray settings and printer names in part (b) of FIG. 8, and the image forming apparatus can be set for each sheet feeding tray.

Furthermore, in each of the examples described above, the heating film 211 was used as the feeding rotatable member to perform the prediction calculation of the degree of deterioration. However, the present invention is not limited to this, and may, for example, be applied to the pressure roller 21*a*, which is a component of the fixing portion 21, in addition to the heating film 211. Furthermore, although only the predicted calculation value of the amount of wear of the heating film 211 was used for calculating the lifetime of the fixing portion 21, the lifetime of the fixing portion 21 may be calculated by comprehensively considering the degree of deterioration of other parts that constitute the fixing portion 21 as described above. Moreover, in addition to the fixing portion 21, it is possible to apply this method to all feeding rotatable members that come into contact with the surface of the paper P and contribute to the feeding of the paper P, such as the secondary transfer roller and the paper feed roller.

According to the above the embodiment 3, the lifetime of the replaceable unit can be accurately predicted even for an image forming apparatus that does not have a means to detect the characteristics of the recording medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-118453 filed on Jul. 9, 2020, which is hereby incorporated by reference herein in its entirety.

What is claimed is:

1. An image forming system comprising:

a first image forming apparatus including a first stacking portion configured to stack a first recording medium, a feeding rotatable member configured to feed the first feeding medium, an arithmetic portion configured to obtain a degree of deterioration of said feeding rotatable member, and a setting portion configured to set so as to associate the other stacking portion with said first stacking portion;

a second image forming apparatus different from said first image forming apparatus, said second image forming apparatus including a second stacking portion configured to stack a second recording medium, and a detecting portion configured to detect a characteristics of the second recording medium; and a network line configured to connect said first image forming apparatus and said second image forming apparatus, wherein when said second stacking portion is associated with said first stacking portion by said setting portion, said arithmetic portion acquires information related to the characteristic of the second recording medium detected by said detecting portion via said network line and obtains the degree of deterioration of said feeding rotatable member based on the acquired information related to the characteristic of the second recording medium.

2. An image forming system according to claim 1, wherein the information related to the characteristic of the second recording medium is a characteristic value of the second recording medium, and wherein said arithmetic portion obtains the degree of deterioration based on of an abrasion amount of said feeding rotatable member per one recording medium in feeding the recording medium by said feeding rotatable member or an abrasion amount of said feeding rotatable member per one rotation in feeding the recording medium by said feeding rotatable member, and a correction coefficient according to the characteristic value of the recording medium.

3. An image forming system according to claim 2, wherein said second image forming apparatus includes a memory portion configured to memory the characteristic detected by said detecting portion associated with said second stacking portion.

4. An image forming system according to claim 3, wherein the characteristic value is a surface smoothness and a thickness of the second recording medium.

5. An image forming system according to claim 4, wherein the smaller the surface smoothness is or the thinner the thickness of the second recording medium, the smaller the correction coefficient is.

6. An image forming system according to claim 1, wherein said first image forming apparatus includes a second detecting portion configured to detect a characteristics of the first recording medium fed by said first stacking portion.

7. An image forming system according to claim 6, wherein said second detecting portion detects a thickness of the first recording medium.

8. An image forming system according to claim 6, wherein a number of the characteristics of the first recording medium detected by said second detecting portion is smaller than that of the characteristics of the second recording medium detected by said detecting portion.

9. An image forming system according to claim 6, wherein said arithmetic portion obtains the degree of deterioration of said feeding rotatable member based on the acquired information related to the characteristic of the second recording medium obtained via said network line and the information related to the characteristic of the first recording medium obtained by said first detecting portion.

10. An image forming system according to claim 1, wherein said first image forming apparatus is provided with a fixing portion, including said feeding rotatable member as a heating film and a pressing roller, configured to fix an unfixed toner on which the first recording medium, and wherein said arithmetic portion obtains an abrasion amount of said heating film as the degree of deterioration.

11. An image forming apparatus comprising:

a first stacking portion configured to stack a first recording medium, a feeding rotatable member configured to feed the first feeding medium, an arithmetic portion configured to obtain a degree of deterioration of said feeding rotatable member, and a setting portion configured to set so as to associate the other stacking portion with said first stacking portion, wherein said image forming apparatus is connected to the other image forming apparatus via a network line, said the other image forming apparatus including a second stacking portion configured to stack a second recording medium and a detecting portion configured to detect a characteristic of the second recording medium, wherein when said second stacking portion is associated with said first stacking portion by said setting portion, said arithmetic portion acquires information related to the characteristic of the second recording medium detected by said detecting portion via said network line and obtains the degree of deterioration of said feeding rotatable member based on the acquired information related to the characteristic of the second recording medium.

12. An image forming apparatus according to claim 11, wherein said image forming apparatus includes a second detecting portion configured to detect a characteristics of the first recording medium fed by said first stacking portion.

13. An image forming apparatus according to claim 12, wherein said second detecting portion detects a thickness of the first recording medium.

14. An image forming apparatus according to claim 12, wherein a number of the characteristics of the first recording medium detected by said second detecting portion is smaller than that of the characteristics of the second recording medium detected by said detecting portion.

15. An image forming apparatus according to claim 12, wherein said arithmetic portion obtains the degree of deterioration of said feeding rotatable member based on the acquired information related to the characteristic of the second recording medium obtained via said network line and the information related to the characteristic of the first recording medium obtained by said first detecting portion.

16. An image forming apparatus according to claim 11, wherein said image forming apparatus is provided with a fixing portion, including said feeding rotatable member as a heating film and a pressing roller, configured to fix an unfixed toner on which the first recording medium, and wherein said arithmetic portion obtains an abrasion amount of said heating film as the degree of deterioration.

* * * * *